US009988964B2

(12) United States Patent
Sato

(10) Patent No.: US 9,988,964 B2
(45) Date of Patent: Jun. 5, 2018

(54) EBULLIENT COOLING DEVICE

(71) Applicant: TOYOTA JIDOSHA KABUSHIKI KAISHA, Toyota-shi, Aichi-ken (JP)

(72) Inventor: Masahiro Sato, Mishima (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 51 days.

(21) Appl. No.: 15/315,827

(22) PCT Filed: May 26, 2015

(86) PCT No.: PCT/JP2015/065051
§ 371 (c)(1),
(2) Date: Dec. 2, 2016

(87) PCT Pub. No.: WO2015/186565
PCT Pub. Date: Dec. 10, 2015

(65) Prior Publication Data

US 2017/0101919 A1 Apr. 13, 2017

(30) Foreign Application Priority Data

Jun. 5, 2014 (JP) ..... 2014-116922

(51) Int. Cl.
*F01P 9/02* (2006.01)
*F01P 3/22* (2006.01)

(52) U.S. Cl.
CPC ..... *F01P 3/22* (2013.01); *F01P 2003/2264* (2013.01)

(58) Field of Classification Search
CPC .... F01P 3/22; F01P 2003/2264; F01P 3/2271; F01P 7/026
(Continued)

(56) References Cited

U.S. PATENT DOCUMENTS 6,250,099 B1 * 6/2001 Furuya ..... F25B 1/10 62/473
8,661,817 B2 * 3/2014 Harmon, Sr. ..... F01B 7/20 123/41.2
(Continued)

FOREIGN PATENT DOCUMENTS

JP 2010-223116 10/2010
JP 2010-285896 12/2010

*Primary Examiner* — Marguerite McMahon
*Assistant Examiner* — Tea Holbrook
(74) *Attorney, Agent, or Firm* — Finnegan, Henderson, Farabow, Garrett & Dunner, LLP

(57) ABSTRACT

An ebullient cooling device includes: an internal combustion engine cooled by boiling a coolant flowing through a coolant passage formed within the internal combustion engine; a gas-liquid separator that separates a coolant discharged from the internal combustion engine into a liquid-phase coolant and a gas-phase coolant; a condenser that is disposed on a downstream side of the expander, and cools the gas-phase coolant having passed through the expander so as to be changed into a liquid-phase coolant; a first passage that supplies the liquid-phase coolant from the condenser to the coolant passage formed within the internal combustion engine; a second passage that is branched from the first passage, and is connected to the gas-liquid separator; and a control valve that controls a supply state of a liquid-phase coolant supplied to the gas-liquid separator from the condenser through the second passage.

4 Claims, 12 Drawing Sheets

(58) Field of Classification Search
USPC ..... 123/41.01, 41.2, 41.21
See application file for complete search history.

(56) References Cited

U.S. PATENT DOCUMENTS

| | | | | |
|---|---|---|---|---|
| 2013/0025277 | A1* | 1/2013 | Enokijima | F01K 23/065 60/615 |
| 2016/0115855 | A1* | 4/2016 | Sato | F01P 3/2271 123/41.21 |
| 2017/0101919 | A1* | 4/2017 | Sato | F01P 3/22 |

* cited by examiner

EBULLIENT COOLING DEVICE

CROSS-REFERENCE TO RELATED APPLICATIONS

This application is a national phase application of International Application No. PCT/JP2015/065051, filed May 26, 2015, and claims the priority of Japanese Application No. 2014-116922, filed Jun. 5, 2014, the content of both of which is incorporated herein by reference.

TECHNICAL FIELD

The present invention is related to an ebullient cooling device.

BACKGROUND ART

As a cooling device for an internal combustion engine, there is known an ebullient cooling device that cools it by utilizing boiling evaporation heat of a coolant flowing through a coolant passage (for example, a water jacket) formed within the internal combustion engine. The ebullient cooling device has the coolant passage that is connected to, for example, a gas-liquid separator. The gas-liquid separator separates the coolant discharged from the coolant passage into a liquid-phase coolant and a gas-phase coolant. Additionally, there is known the ebullient cooling device that supplies the liquid-phase coolant to the coolant passage from a condenser through the gas-liquid separator when the cooling of the internal combustion engine is insufficient (for example, see Patent Documents 1 and 2).

PRIOR ART DOCUMENT

Patent Document

[Patent Document 1] Japanese Unexamined Patent Application Publication No. 2010-223116

[Patent Document 2] Japanese Unexamined Patent Application Publication No. 2010-285896

SUMMARY OF THE INVENTION

Problems to be Solved by the Invention

A reduction in the pressure within the gas-liquid separator might vigorously boil the coolant within the coolant passage as depending on the manner of pressure reduction. The vigorous boil might generate many bubbles, which might lower the liquid level. Consequently, a portion to be cooled might be exposed not to be cooled. In Patent Documents 1 and 2, the liquid-phase coolant is supplied to the coolant passage from the condenser through the gas-liquid separator, when the cooling of the internal combustion engine is insufficient. However, the liquid-phase coolant might be heated in the gas-liquid separator in this case, so it might be difficult to supply the liquid-phase coolant sufficiently cooled (that is, with high cooling efficiency) to the coolant passage. It might be therefore difficult to suppress the coolant from boiling vigorously within the coolant passage.

The present invention has been made in view of the above problems and has an object to provide an ebullient cooling device capable of suppressing a coolant from boiling vigorously within a coolant passage.

Means for Solving the Problems

The present invention is an ebullient cooling device including: an internal combustion engine cooled by boiling a coolant flowing through a coolant passage formed within the internal combustion engine; a gas-liquid separator that is disposed between the internal combustion engine and an expander, and separates a coolant discharged from the internal combustion engine into a liquid-phase coolant and a gas-phase coolant; a condenser that is disposed on a downstream side of the expander, and cools the gas-phase coolant having passed through the expander so as to be changed into a liquid-phase coolant; a first passage that supplies the liquid-phase coolant from the condenser to the coolant passage formed within the internal combustion engine; a second passage that is branched from the first passage, and is connected to the gas-liquid separator; a control valve that controls a supply state of a liquid-phase coolant supplied to the gas-liquid separator from the condenser through the second passage; a temperature obtainer that obtains a temperature value of the coolant flowing through the coolant passage; a pressure obtainer that obtains a pressure value within the gas-liquid separator; and a controller that controls the control valve based on a temperature value Obtained by the temperature obtainer and on a pressure value obtained by the pressure obtainer. According to the present invention, the coolant can be suppressed from boiling vigorously within the coolant passage.

The controller may control the control valve such that a liquid-phase coolant does not flow into the gas-liquid separator from the condenser through the second passage, when a temperature value obtained by the temperature obtainer is greater than a threshold temperature predetermined at a pressure value obtained by the pressure obtainer.

The controller may control the control valve such that a liquid-phase coolant does not flow into the gas-liquid separator from the condenser through the second passage, when a difference between a temperature value obtained by the temperature obtainer and a boiling temperature of the coolant at a pressure value obtained by the pressure obtainer is greater than a difference between a threshold temperature predetermined at a pressure value obtained by the pressure obtainer and a boiling temperature of the coolant at a pressure value obtained by the pressure obtainer.

A pressure relief valve that reduces the pressure within the gas-liquid separator may be included, and the controller may control the control valve, on a basis of a temperature value obtained by the temperature obtainer and a pressure value obtained by the pressure obtainer after the pressure relief valve is opened.

Effects of the Invention

According to the present invention, it is possible to provide an ebullient cooling device capable of suppressing a coolant from boiling vigorously within a coolant passage.

MODES FOR CARRYING OUT THE INVENTION

Figure 1:
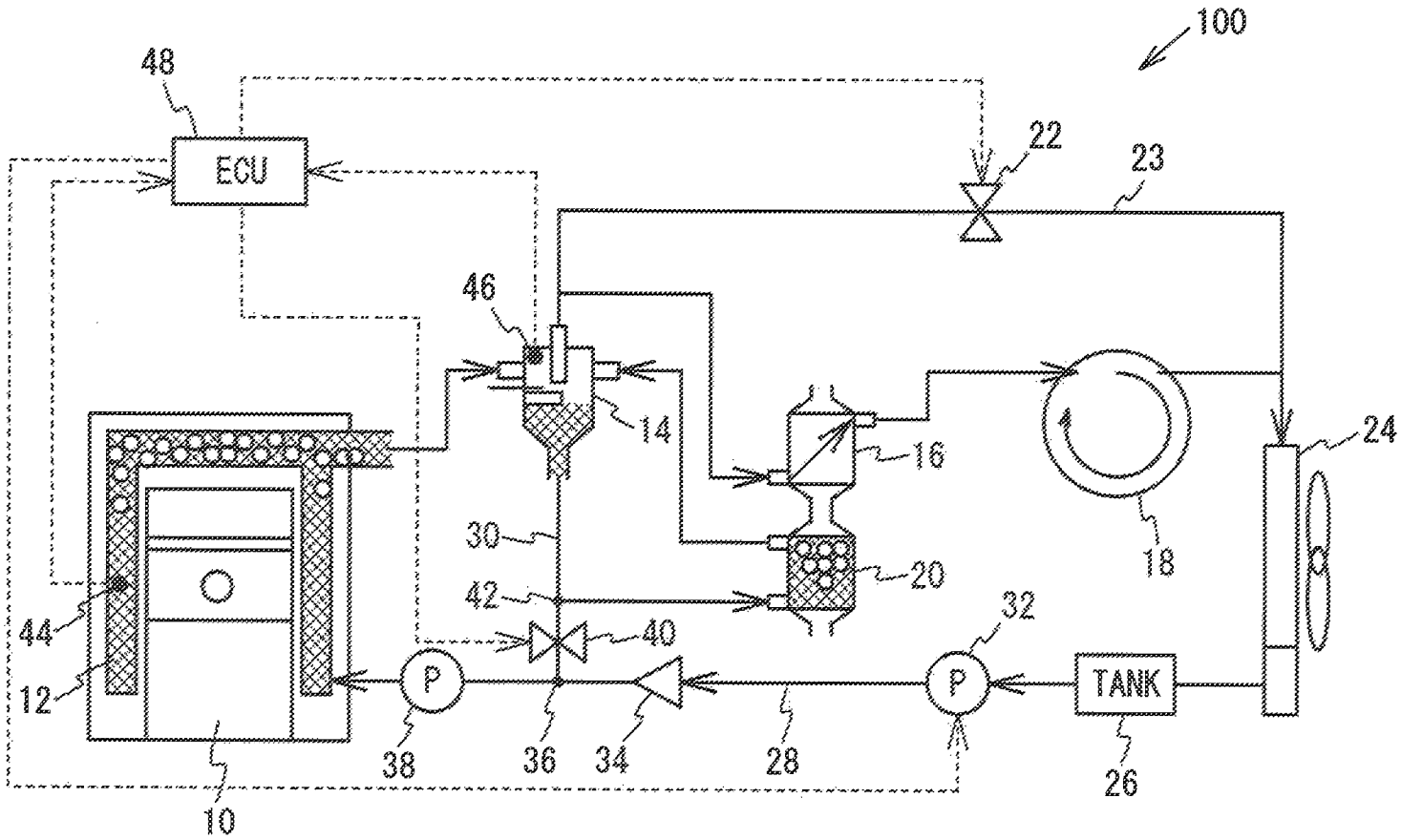
FIG. 1 is a schematic view illustrating a configuration of an ebullient cooling device according to the first embodiment.

Referring to the drawings, a description will be given of embodiments of the present invention.

First Embodiment

FIG. 1 is a schematic view illustrating the configuration of an ebullient cooling device 100 according to the first embodiment. As illustrated in FIG. 1, in the ebullient cooling device 100 according to the first embodiment, a coolant passage 12 formed within an internal combustion engine 10 is connected to a gas-liquid separator 14. The gas-liquid separator 14 is connected to the coolant passage 12 through, for example, a tube, not a valve. Additionally, they may be connected through a hose, instead of the tube. The coolant flowing through the coolant passage 12 is boiled by absorbing heat from the internal combustion engine 10, which cools the internal combustion engine 10. The coolant passage 12 is, for example, a water jacket formed around a cylinder of the internal combustion engine 10, but may be another form capable of cooling the internal combustion engine 10 by the coolant within the coolant passage 12. The coolant flowing through the coolant passage 12 is not particularly limited as long as it is liquid which is boiled by absorbing the heat from the internal combustion engine 10.

The coolant having flowed through the coolant passage 12 is discharged from a coolant outlet, and flows into the gas-liquid separator 14. The gas-liquid separator 14 separates the coolant discharged from the coolant passage 12 into a liquid-phase coolant and a gas-phase coolant.

The gas-phase coolant separated by the gas-liquid separator 14 flows into a superheater 16 to which an exhaust gas is drawn from the internal combustion engine 10. The superheater 16 changes the gas-phase coolant flowing from the gas-liquid separator 14 into superheated steam by utilizing waste heat of the internal combustion engine 10. The superheated steam generated by the superheater 16 flows into an expander 18 (for example, a turbine). A part of the gas-liquid-phase coolant separated by the gas-liquid separator 14 flows into an exhaust heat steam generator 20 to which the exhaust gas is drawn from the internal combustion engine 10. The exhaust heat steam generator 20 heats the liquid-phase coolant by utilizing the waste heat of the internal combustion engine 10 and generates steam. After the steam generated by the exhaust heat steam generator 20 is returned to the gas-liquid separator 14, the steam is changed into superheated steam by the superheater 16, and then flows into the expander 18. Thus, the gas-liquid separator 14 is disposed between the internal combustion engine 10 and the expander 18.

The expander 18 is driven by the superheated steam having flowed thereinto from the superheater 16. The expander 18 is connected to, for example, a generator that generates electricity by utilizing the driving force of the expander 18. In this case, the expander 18 is driven by the superheated steam superheated by the waste heat of the internal combustion engine 10, and generates electricity. It is thus possible to recover the driving force from the internal combustion engine 10.

The gas-liquid separator 14 is connected to a pressure relief valve 22 for reducing the pressure of the gas phase within the gas-liquid separator 14. The pressure relief valve 22 is, for example, an electromagnetic valve. The opening of the pressure relief valve 22 causes the gas-phase coolant within the gas-liquid separator 14 to pass through a bypass passage 23 that does not pass through the expander 18 and the like, which reduces the pressure within the gas-liquid separator 14.

The superheated steam having passed through the expander 18 and the gas-phase coolant having passed through the pressure relief valve 22 (bypass passage 23) flow into a condenser 24 disposed on the downstream side of the expander 18. The condenser 24 is a heat exchanger such as a radiator changing gas into liquid. The liquid-phase coolant changed by the condenser 24 is temporarily stored in a tank 26.

The tank 26 and the coolant passage 12 are connected through a first passage 28. Further, the first passage 28 and the gas-liquid separator 14 are connected through a second passage 30 that has one end connected to the first passage 28 and the other end connected to the gas-liquid separator 14. That is, the gas-liquid separator 14 is connected to the second passage 30 branched at a branch portion 36 from the first passage 28. On the first passage 28, a first pump 32, a check valve 34, and a second pump 38 are disposed in this order from the tank 26 side. The branch portion 36 between the first passage 28 and the second passage 30 is located between the check valve 34 and the second pump 38.

The first pump 32 is a pump feeding a liquid-phase coolant stored in the tank 26 to the coolant passage 12. The first pump 32 is controlled to be ON or OFF, in a normal mode, on the basis of a sensor detecting the liquid level of the liquid-phase coolant within the gas-liquid separator 14. The first pump 32 is capable of retuning the liquid-phase coolant, for example, from a low pressure region (for example, from about 10 kPaG to about 20 kPaG) into an atmospheric pressure region (for example, about 100 kPaG). The first pump 32 may be, for example, an electric pump. The check valve 34 is provided for suppressing the liquid-phase coolant from reversely flowing.

The second pump 38 is a pump that feeds the liquid-phase coolant flowing from the gas-liquid separator 14 thereto and/or the liquid-phase coolant fed by the first pump 32, to the coolant passage 12. The second pump 38 may be, for example, a mechanical or electric centrifugal pump. Also, when the first pump 32 can ensure adequate circulation amount of the liquid-phase coolant, the second pump 38 may be omitted.

The second passage 30 is provided with a control valve 40. The control valve 40 is provided, for example, between a branch portion 42, between the gas-liquid separator 14 on the second passage 30 and the exhaust heat steam generator 20, and the branch portion 36, between and the second passage 30 and the first passage 28. The control valve 40 is, for example, an electromagnetic valve. The closing of the control valve 40 preferentially supplies the liquid-phase coolant to the coolant passage 12 from the condenser 24.

A temperature sensor 44 for obtaining a temperature value of the coolant is provided within the coolant passage 12. The temperature sensor 44 is provided at, for example, the lower side of the coolant passage 12. This is because it might be difficult to obtain the temperature value of the coolant on the upper side of the coolant passage 12 on which bubbles gather. A temperature obtainer other than the temperature sensor 44 may be also used, as long as it is possible to obtain the temperature value of the coolant within the coolant passage 12.

A pressure sensor 46 for obtaining a pressure value within the gas-liquid separator 14 is provided within the gas-liquid separator 14. The pressure sensor 46 is provided at a position where the liquid-phase coolant within the gas-liquid separator 14 hardly reach. A pressure obtainer other than the pressure sensor 46 may be used, as long as it is possible to obtain the pressure value of the gas phase in the gas-liquid separator 14.

The ebullient cooling device 100 is provided with an ECU (Electronic Control Unit) 48. The ECU 48 is electrically connected to the pressure relief valve 22, the control valve 40, the first pump 32, the temperature sensor 44, and the pressure sensor 46. The ECU 48 controls the pressure relief valve 22, the control valve 40, and the first pump 32 on the basis of the results obtained by the temperature sensor 44 and the pressure sensor 46. That is, the ECU 48 functions as a controller that controls the pressure relief valve 22, the control valve 40, and the first pump 32.

Figure 2:
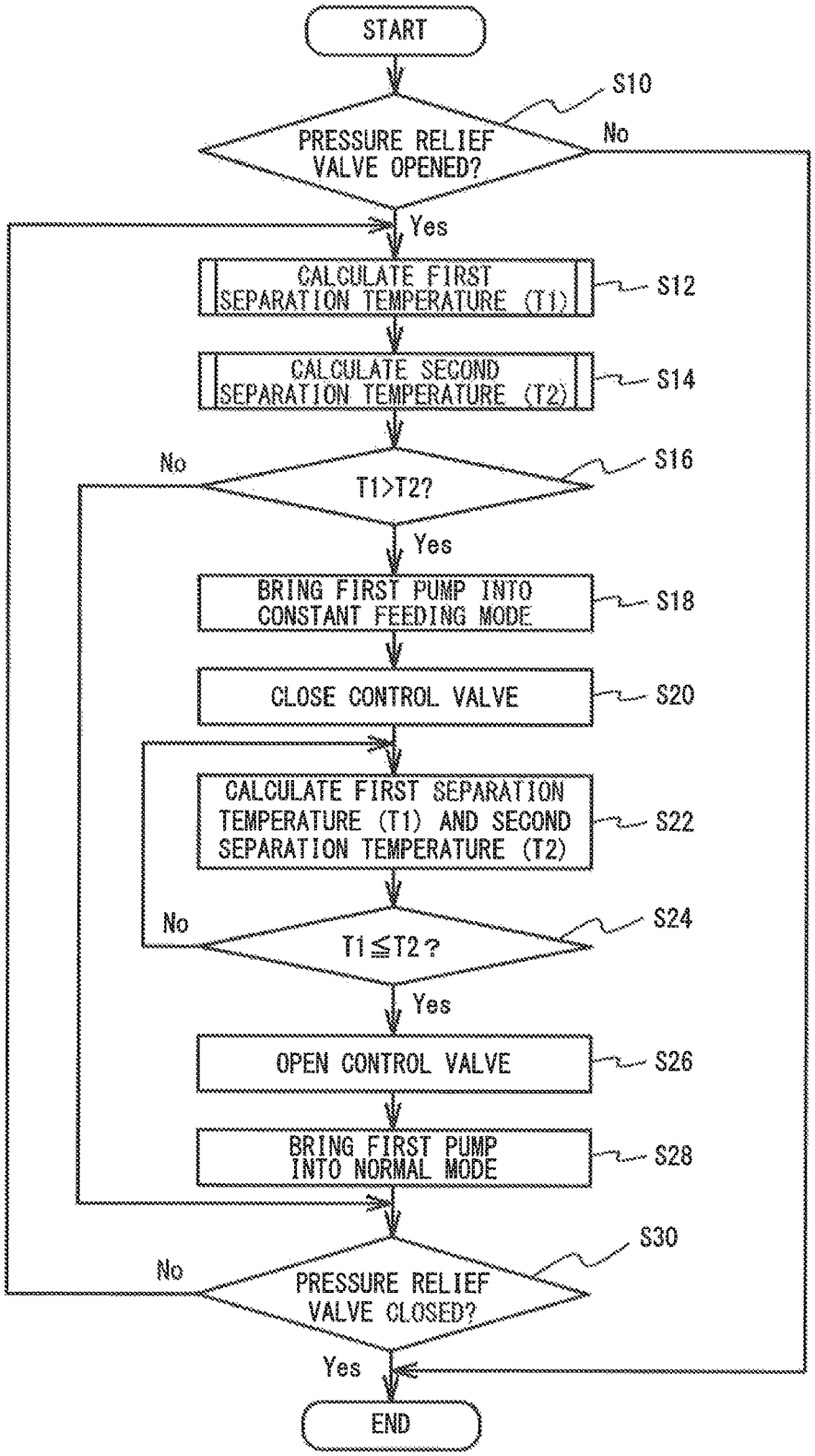
FIG. 2 is a flowchart illustrating an example of control of the ebullient cooling device according to the first embodiment.

Next, the control of the ECU 48 will be described. The control of the ECU 48 is performed by cooperation of hardware, such as a CPU (Central Processing Unit), and software stored in ROM (Read Only Memory). FIG. 2 is a flowchart illustrating an example of the control of the ebullient cooling device 100 according to the first embodiment. In FIG. 2, the ECU 48 determines whether or not the pressure relief valve 22 is opened (step S10). The opening of the pressure relief valve 22 drastically reduces the pressure within the gas-liquid separator 14.

Figure 3:
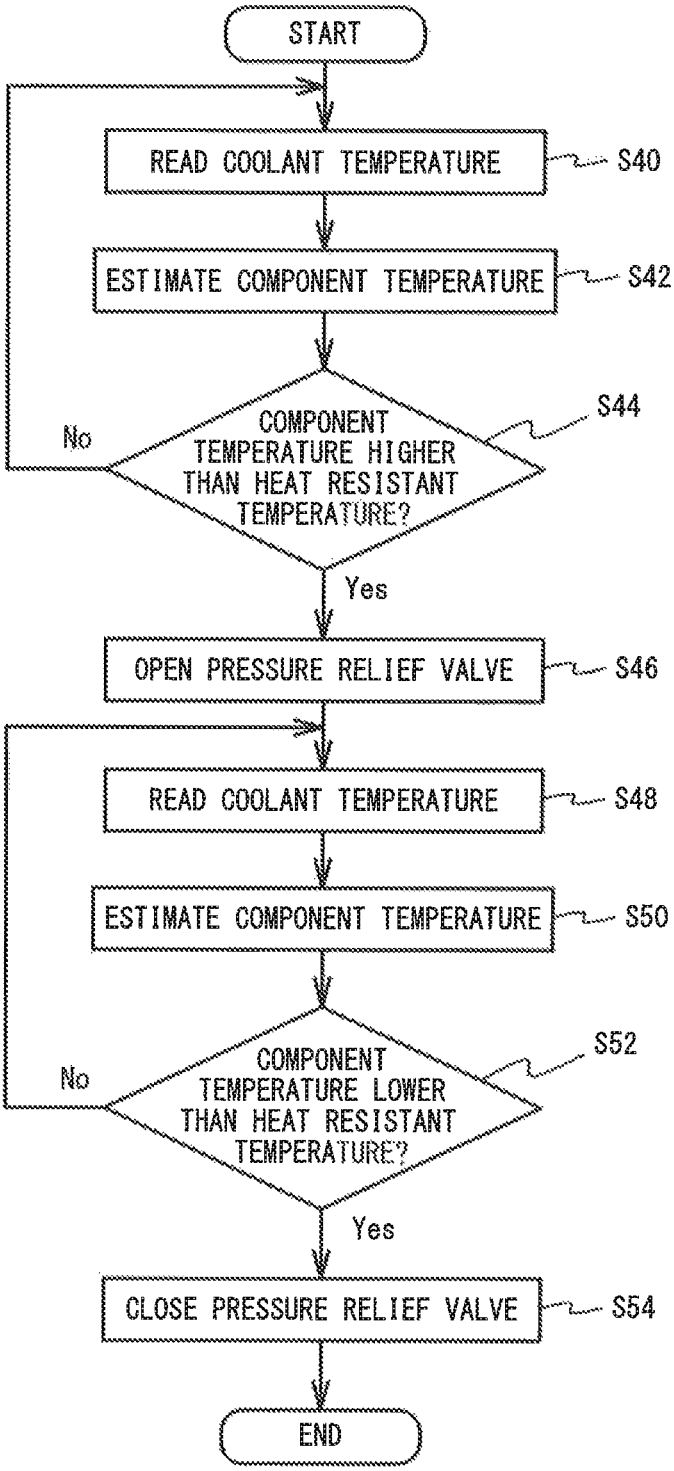
FIG. 3 is a flowchart illustrating an example of control of a pressure relief valve.

As described above, the opening and closing of the pressure relief valve 22 is controlled by the ECU 48. Therefore, a description will be given of the control of the opening and closing of the pressure relief valve 22 by the ECU 48 with reference to FIG. 3. FIG. 3 is a flowchart illustrating an example of the control of the pressure relief valve 22. As illustrated in FIG. 3, the ECU 48 reads the temperature value of the coolant within the coolant passage 12 obtained by the temperature sensor 44 (step S40). The temperature value of the coolant may be also read from other than the temperature sensor 44, as long as it is possible to read the temperature value of the coolant within the coolant passage 12. When there is a temperature distribution of the coolant within the coolant passage 12, the ECU 48 may correct the read temperature value.

The ECU 48 estimates a temperature of a component of the internal combustion engine 10 (for example, a cylinder block or the like) based on the read temperature value of the coolant (step S42). The ECU 48 determines whether or not the estimated temperature of the component is higher than a heat resistant temperature of the component (Step S44). The component temperature is higher than the heat resistance temperature (Yes), the ECU 48 opens the pressure relief valve 22 (step S46). This reduces the pressure within the gas-liquid separator 14 and also reduces the pressure within the coolant passage 12. This promotes boiling of the coolant within the coolant passage 12, so that heat vaporization tends to reduce the temperature of the component. When the component temperature is lower than the heat resistance temperature (No in step S44), the process returns to the step S40.

Even after opening the pressure relief valve 22, the ECU 48 reads the temperature value of the coolant obtained by the temperature sensor 44 (step S48). The ECU 48 estimates the temperature of the component of the internal combustion engine 10 based on the read temperature value of the coolant (step S50). The ECU 48 determines whether or not the estimated temperature of the component is lower than the heat resistance temperature of the component (step S52). When the component temperature is lower than the heat resistance temperature (Yes), the ECU 48 closes the pressure relief valve 22 (step S54). Thus, the gas-phase coolant separated by the gas-liquid separator 14 preferentially flows into the expander 18 through the superheater 16. When the component temperature is still higher than the heat resistance temperature (No in step S52), the process returns to the step S48.

Returning to FIG. 2, when the pressure relief valve 22 is opened (Yes in step S10), the ECU 48 calculates a difference between the temperature of the coolant within the coolant passage 12 and the boiling temperature of the coolant (hereinafter, referred to as first separation temperature) (step S12).

Figure 4:
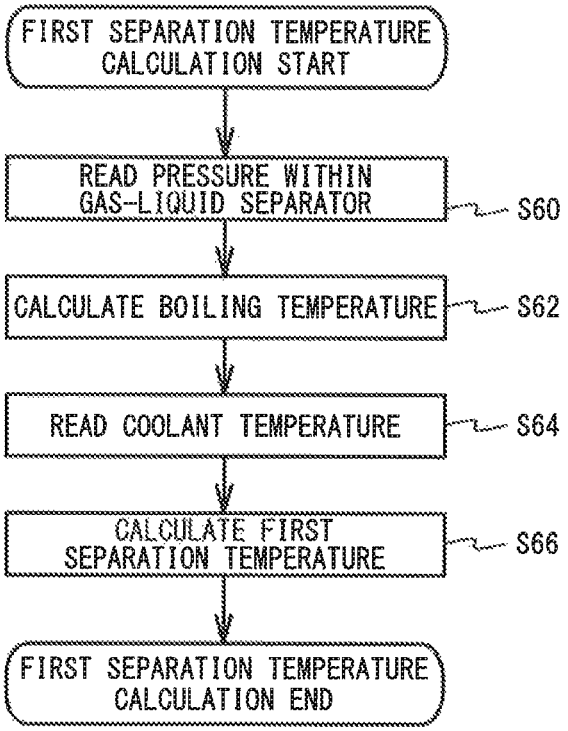
FIG. 4 is a flowchart illustrating an example of a calculation process of a first separation temperature.
Figure 5:
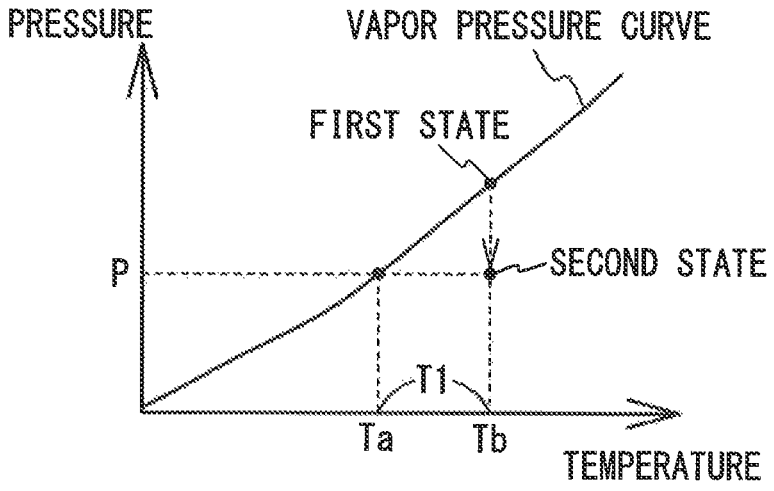
FIG. 5 is a view for explaining the calculation process of the first separation temperature.

Herein, a calculation process of the first separation temperature will be described with reference to FIGS. 4 and 5. FIG. 4 is a flowchart illustrating an example of the calculation process of the first separation temperature, and FIG. 5 is a view explaining the calculation process of the first separation temperature. In FIG. 5, the horizontal axis represents the temperature obtained by the temperature sensor 44, and the vertical axis represents the pressure obtained by the pressure sensor 46. A solid line in FIG. 5 indicates a vapor pressure curve. That is, the solid line in FIG. 5 indicates the boiling temperature of the coolant under certain pressure conditions.

As illustrated in FIG. 4, the ECU 48 reads the pressure value within the gas-liquid separator 14 obtained by the pressure sensor 46 after the pressure relief valve 22 is opened (step S60). The opening of the pressure relief valve 22 drastically reduces the pressure within the gas-liquid separator 14. Thus, in FIG. 5, for example, the ECU 48 reads the pressure P in the second state in which the pressure is drastically reduced from the first state.

Subsequently, the ECU 48 calculates the boiling temperature at the read pressure value on the basis of the vapor pressure curve (step S62). For example, in FIG. 5, the ECU 48 calculates the boiling temperature Ta at the pressure P. That is, the boiling temperature Ta is the boiling temperature of the coolant at the pressure value obtained by the pressure obtainer (pressure sensor 46).

Subsequently, the ECU 48 reads the temperature value of the coolant within the coolant passage 12 obtained by the temperature sensor 44 (step S64). For example, in FIG. 5, the ECU 48 reads the temperature Tb in the second state. That is, the temperature Tb is the temperature value obtained by the temperature obtainer (temperature sensor 44). When there is a temperature distribution of the coolant within the coolant passage 12, the ECU 48 may correct the temperature value.

Then, the ECU 48 calculates the first separation temperature on the basis the difference between the read temperature value of the coolant and the calculated boiling temperature (step S66). In FIG. 5, for example, the ECU 48 calculates the first separation temperature T1 as the difference between the temperature Tb and the boiling temperature Ta. That is, the first separation temperature T1 is the difference between the temperature value obtained by the temperature obtainer (temperature sensor 44) and the boiling temperature of the coolant at the pressure value obtained by the pressure obtainer (pressure sensor 46).

Returning to FIG. 2, the ECU 48 calculates the difference (hereinafter, referred to as second separation temperature) between a predetermined threshold temperature of the coolant and the boiling temperature of the coolant within the coolant passage 12 (step S14). Additionally, the threshold temperature is, for example, a temperature at which whether or not the coolant vigorously boils under certain pressure conditions. That is, under certain pressure conditions, vigorous boiling occurs at a temperature higher than the threshold temperature, whereas vigorous boiling is suppressed at a temperature equal to or lower than the threshold temperature.

Figure 6:
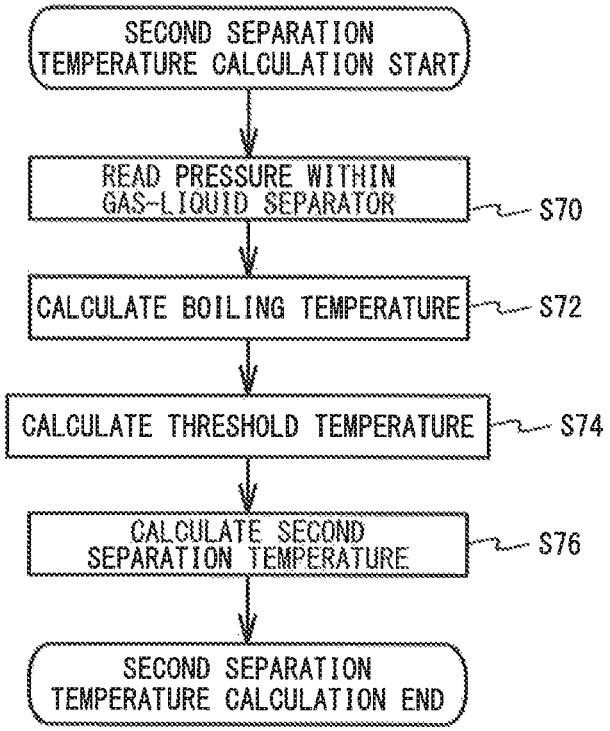
FIG. 6 is a flowchart illustrating an example of a calculation process of a second separation temperature.
Figure 7A:
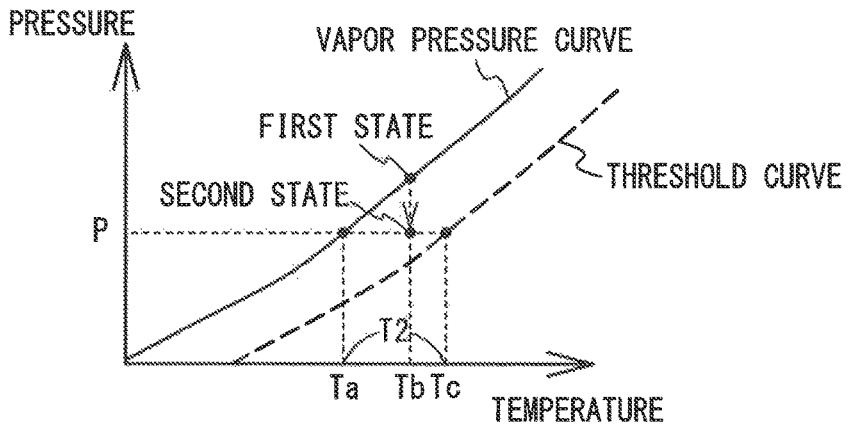
FIG. 7A and FIG. 7B are views for explaining the calculation processing of the second separation temperature.
Figure 7B:
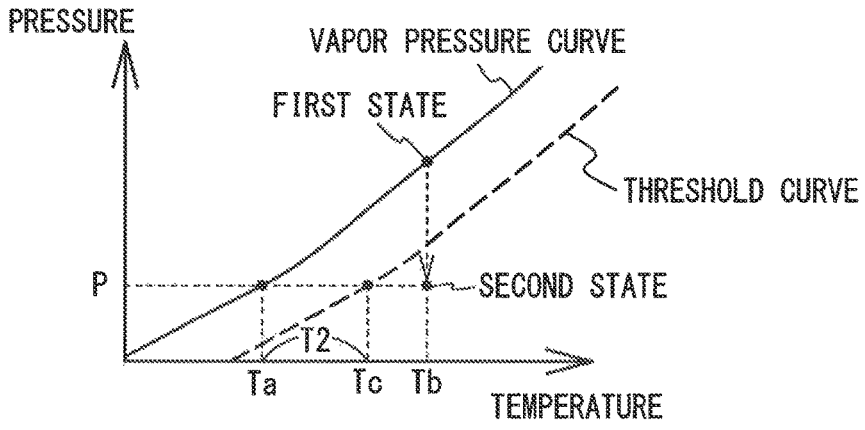

Herein, the calculation of the second separation temperature will described with reference to FIGS. 6 to 7B. FIG. 6 is a flowchart illustrating an example of the calculating process of the second separation temperature. FIGS. 7A and 7B are views explaining the calculation process of the second separation temperature. Note that FIG. 7A illustrates the temperature of the coolant in the second state is equal to or lower than the threshold temperature after the pressure relief valve 22 is opened. FIG. 7B illustrates the temperature of the coolant higher than the threshold temperature. The horizontal axes in FIG. 7A and FIG. 7B represent the temperature obtained by the temperature sensor 44, and the vertical axes represent the pressure obtained by the pressure sensor 46. In FIGS. 7A and 7B, solid lines indicate a vapor pressure curve, and broken lines indicate a threshold curve.

As illustrated in FIG. 6, the ECU 48 reads the pressure value within the gas-liquid separator 14 obtained by the pressure sensor 46 after the pressure relief valve 22 is opened (step S70). For example, in FIG. 7A and FIG. 7B, the ECU 48 reads the pressure P in the second state to which the pressure is drastically reduced from the first state.

Subsequently, the ECU 48 calculates the boiling temperature at the read pressure value on the basis of the vapor pressure curve (step S72). In FIG. 7A and FIG. 7B, for example, the ECU 48 calculates the boiling temperature Ta at the pressure P.

Subsequently, the ECU 48 calculates a threshold temperature at the read pressure value (step S74). In FIG. 7A and FIG. 7B, for example, the ECU 48 calculates a threshold temperature Tc at the pressure P. That is, the threshold temperature Tc is a predetermined threshold temperature of the coolant at the pressure value obtained by the pressure obtainer (pressure sensor 46).

Subsequently, the ECU 48 calculates the second separation temperature based on the difference between the calculated threshold temperature and the boiling temperature (step S76). In FIG. 7A and FIG. 7B, for example, the ECU 48 calculates the second separation temperature T2 as the difference between the threshold temperature Tc and the boiling temperature Ta. That is, the second separation temperature T2 is the difference between the predetermined threshold temperature of the coolant at the pressure value obtained by the pressure obtainer (pressure sensor 46) and the boiling temperature of the coolant at the pressure value obtained by the pressure obtainer.

Returning to FIG. 2, the ECU 48 determines whether or not the first separation temperature (T1) is greater than the second separation temperature (T2) (step S16). When the first separation temperature is greater than the second separation temperature (Yes), the ECU 48 changes the control for the first pump 32 from the control based on the liquid level of the liquid-phase coolant within the gas-liquid separator 14 (normal mode) into the control to continue feeding the liquid-phase coolant by constantly driving the first pump 32 (constant feeding mode) (step S18). The ECU 48 closes the control valve 40 after changing the control for the first pump 32 into the constant feeding mode (step S20). Further, the order of step S18 and step S20 may be changed, and step S18 and step S20 may be performed simultaneously.

When the first separation temperature is greater than the second separation temperature (such as the case illustrated in FIG. 7B), the coolant might boil vigorously within the coolant passage 12. Thus, with the above-described control, the liquid-phase coolant from the condenser 24 is preferentially supplied to the coolant passage 12 without passing through the gas-liquid separator 14, which can supply the sufficiently cold coolant (that is, high cooling efficiency) into the coolant passage 12.

In step S16, when the first separation temperature is equal to or lower than the second separation temperature (No), that is, in the case illustrated in FIG. 7A, the process goes to step S30 described later without performing the above control, because the coolant may not boil vigorously within the coolant passage 12.

The ECU 48 calculates the first separation temperature and second separation temperature after closing the control valve 40 (step S22), and the ECU 48 determines whether or not the first separation temperature is equal to or less than the second separation temperature due to the supply of the sufficiently cold coolant to the coolant passage 12 (step S24). When the first separation temperature is still greater than the second separation temperature (No), the process returns to step S22 and the ECU 48 repeatedly calculates the first separation temperature and the second separation temperature. When the first separation temperature is equal to or lower than the second separation temperature (Yes), the ECU 48 opens the control valve 40 (step S26). Then, the ECU 48 returns the control for the first pump 32 into the normal mode (step S28). Additionally, the order of step S26 and step S28 may be changed, and step S26 and step S28 may be performed simultaneously.

Subsequently, the ECU 48 determines whether or not the pressure relief valve 22 is closed (step S30). When the pressure relief valve 22 is closed (Yes), the process is finished. When the pressure relief valve 22 is still open (No), the process returns to the step S12.

Figure 8:
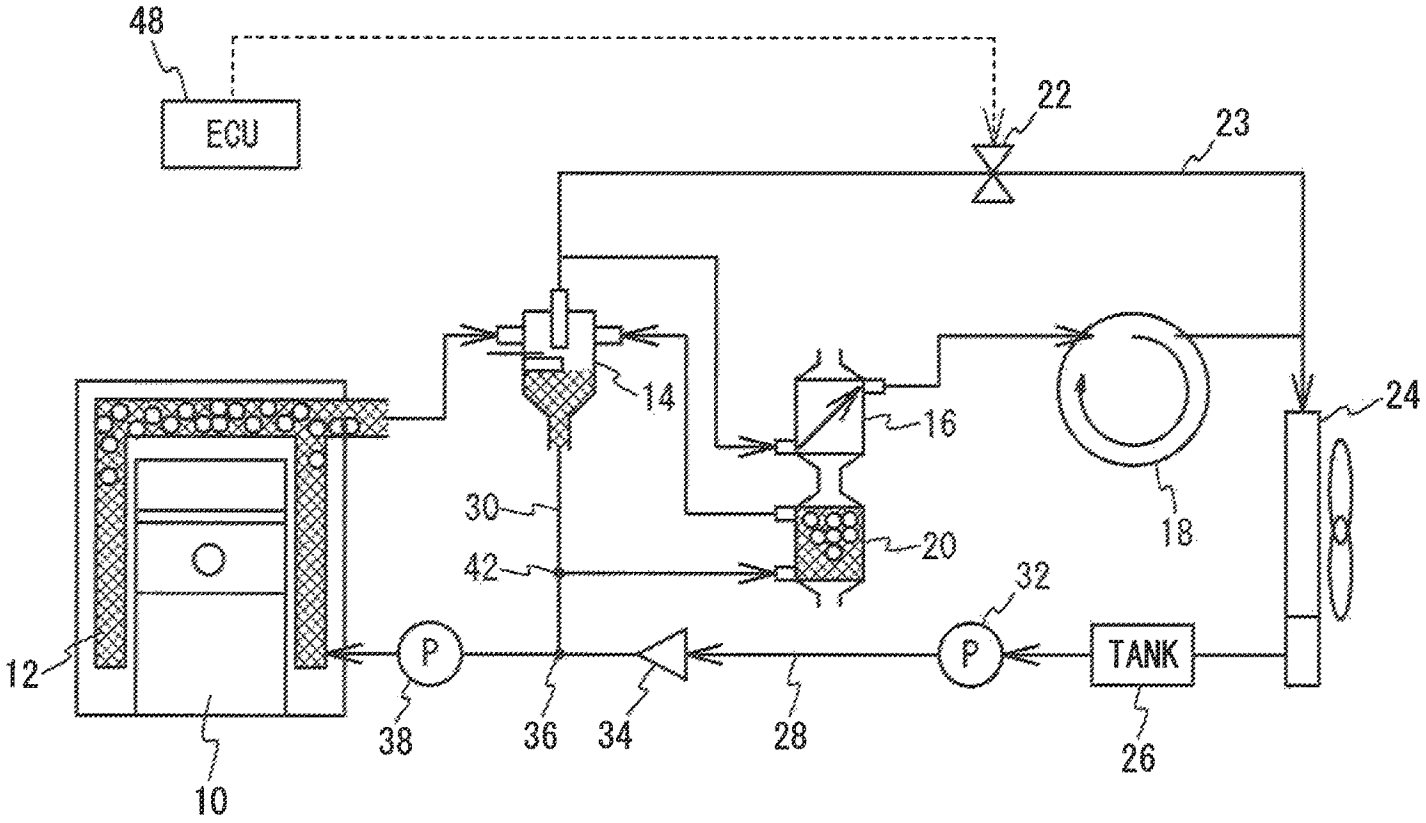
FIG. 8 is a schematic view illustrating a configuration of an ebullient cooling device according to the first comparative example.

Herein, to describe the effects of the ebullient cooling device 100 according to the first embodiment, an ebullient cooling device according to the first comparative example will described. FIG. 8 is a schematic view illustrating the configuration of the ebullient cooling device according to the first comparative example. As illustrated in FIG. 8, the ebullient cooling device according to the first comparative example is not provided with the control valve 40 on the second passage 30. The temperature sensor 44 and pressure sensor 46 also are not provided. In addition, the first pump 32 is always operated in the normal mode. The other structure is the same as the first embodiment illustrated in FIG. 1, so the description of the other structure will be omitted.

Figure 9:
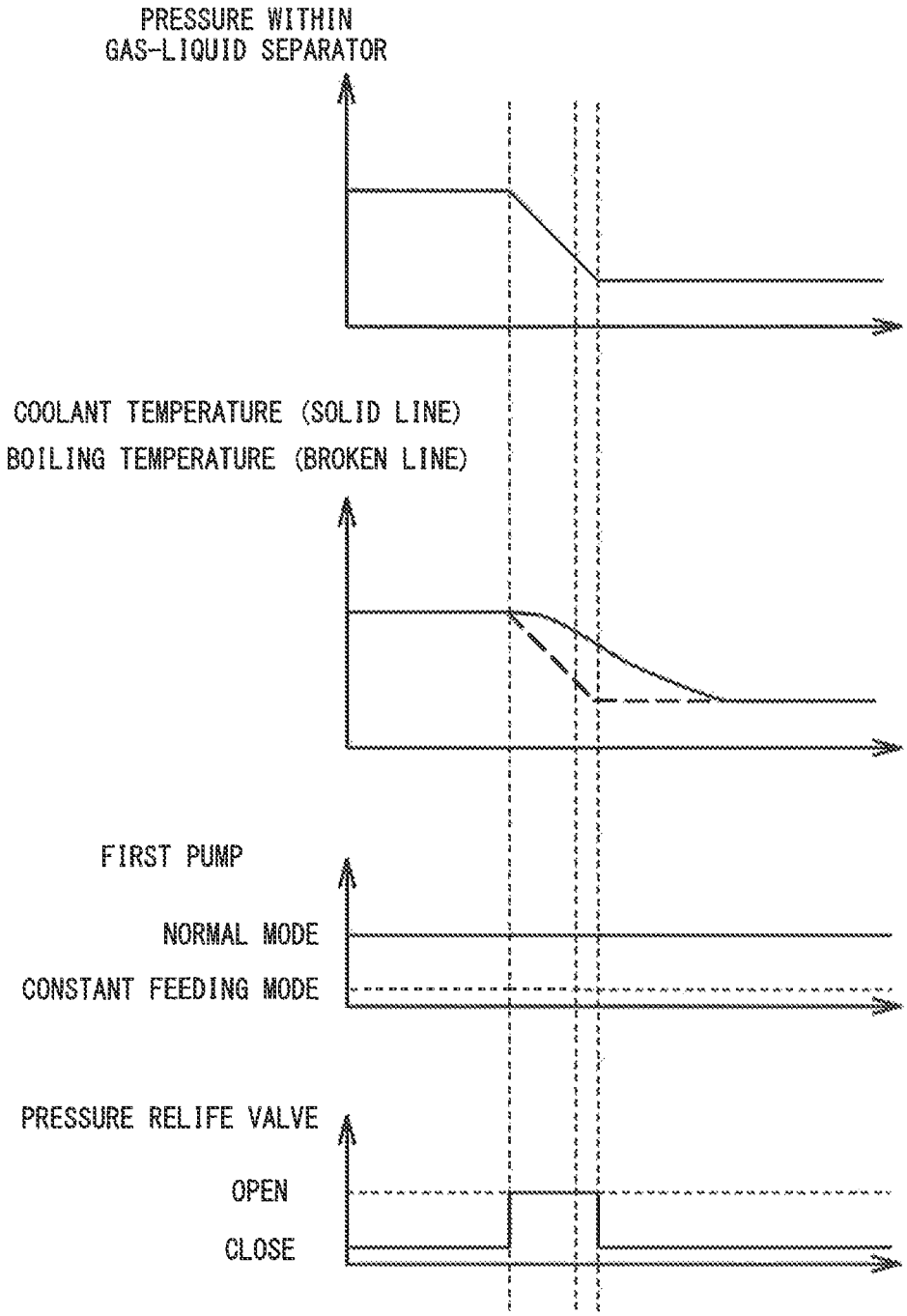
FIG. 9 is a timing chart illustrating an example of fluctuation in a pressure within a gas-liquid separator and in a temperature of a coolant within a coolant passage in the first comparative example.

FIG. 9 is a timing chart illustrating an example of fluctuation in the pressure within the gas-liquid separator 14 and in the temperature of the coolant within the coolant passage 12 in the first comparative example. As illustrated in FIG. 9, the first pump 32 is always operated in the normal mode. The ECU 48 opens the pressure relief valve 22 so as to promote cooling by the coolant within the coolant passage 12, which drastically reduces the pressure in the gas-liquid separator 14. Also, this drastically reduces the pressure within the coolant passage 12, which drastically reduces the boiling temperature of the coolant within the coolant passage 12. When the reduction amount in the pressure is large, or when the pressure is reduced for short time, the difference between the temperature of the coolant within the coolant passage 12 and the boiling temperature is increased, which vigorously boils the coolant.

Figure 10:
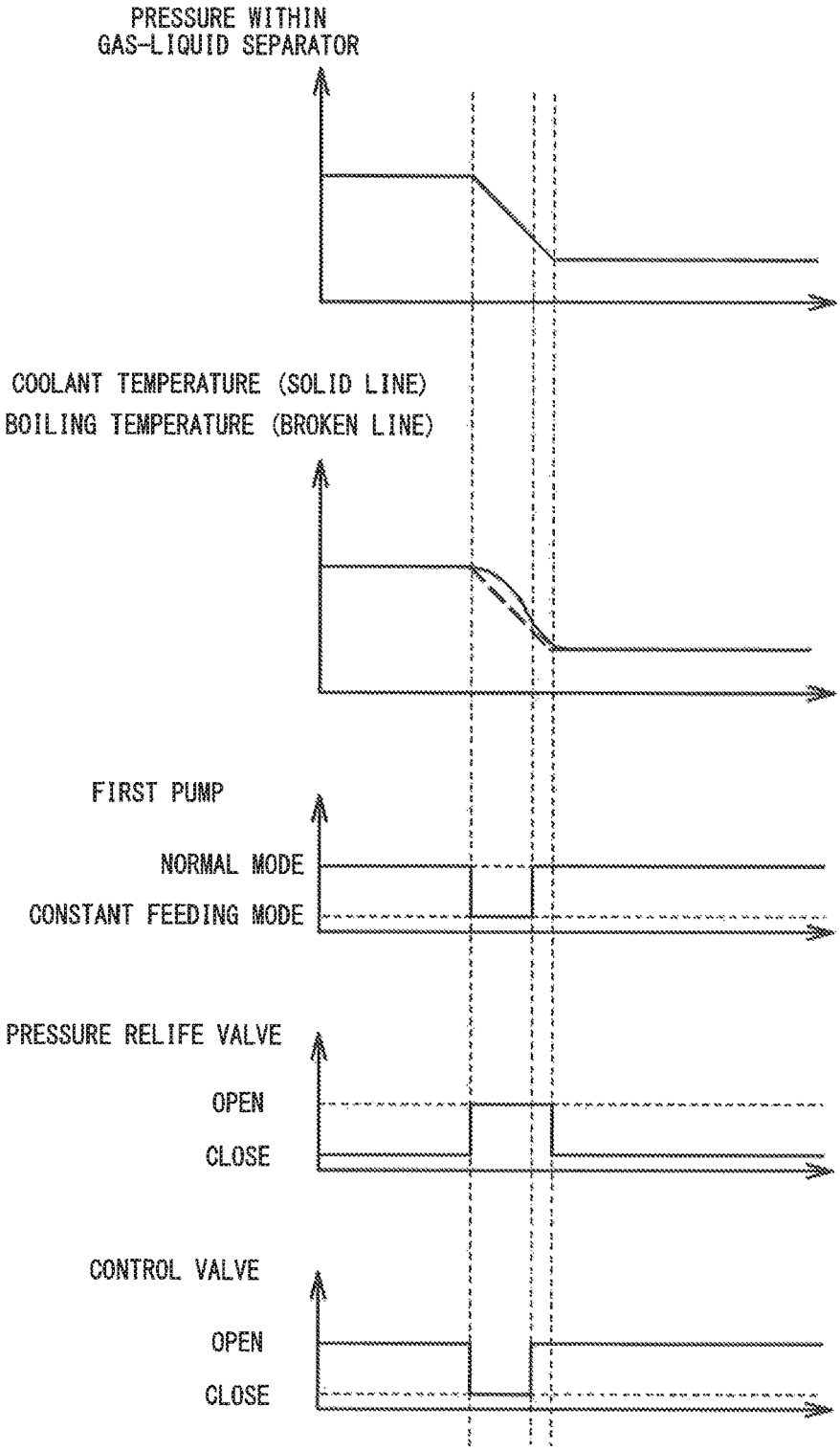
FIG. 10 is a timing chart illustrating an example of fluctuation in a pressure within a gas-liquid separator and in a temperature of a coolant within a coolant passage in the first embodiment.

FIG. 10 is a timing chart illustrating an example of fluctuation in the pressure within the gas-liquid separator 14 and in the temperature of the coolant within the coolant passage 12 in the first embodiment. As illustrated in FIG. 10, the opening of the pressure relief valve 22 drastically reduces the pressure within the gas-liquid separator 14 and the boiling temperature of the coolant within the coolant passage 12. However, in the first embodiment, the control valve 40 is closed in the constant feeding mode for constantly driving the first pump 32, so that the liquid-phase coolant is preferentially supplied to the coolant passage 12 from the condenser 24, thereby supplying the sufficiently cold coolant into the coolant passage 12. This makes it possible to reduce the difference between the temperature of the coolant within the coolant passage 12 and the boiling temperature, thereby suppressing the coolant from boiling vigorously.

As illustrated in FIG. 1, the first embodiment is provided with the first passage 28 that supplies the liquid-phase coolant from the condenser 24 to the coolant passage 12, and the second passage 30 that is branched from the first passage 28 and is connected to the gas-liquid separator 14. Moreover, the ECU 48 controls the control valve 40 based on the pressure value obtained by the pressure sensor 46 and the temperature value obtained by the temperature sensor 44, thereby controlling the supply state of the liquid-phase coolant from the condenser 24 to the gas-liquid separator 14 through the second passage 30. Thus, when the coolant might boil vigorously within the coolant passage 12, the liquid-phase coolant can be supplied preferentially to the coolant passage 12 from the condenser 24 without passing through the gas-liquid separator 14. It is therefore possible to supply the sufficiently cold coolant to the coolant passage 12 and to suppress the coolant from boiling vigorously within the coolant passage 12. In addition, the control of the control valve 40 based on the pressure value obtained by the pressure sensor 46 and on the temperature value obtained by the temperature sensor 44 is not limited to the case based on the obtained pressure value and temperature value themselves, and may be the case based on the corrected and obtained pressure value and temperature value.

Further, although the vigorous boiling might occur within the gas-liquid separator 14 due to the reduction in the pressure, a reduction in the level of the liquid-phase coolant within the gas-liquid separator 14 is not a serious problem, because there is no heat source unlike the coolant passage. Furthermore, the opening of the control valve 40 immediately supplies the liquid-phase coolant thereto.

To suppress the coolant from boiling vigorously within the coolant passage 12, it is conceivable that the ECU 48 opens the pressure relief valve 22 and closes the control valve 40 at the same time without referring to the pressure sensor 46 and the temperature sensor 44. However, the ECU 48 preferably controls the control valve 40 such that the liquid-phase coolant does not flow from the condenser 24 into the gas-liquid separator 14 through the second passage 30, when the temperature value obtained by the temperature sensor 44 is greater than the predetermined threshold temperature of the coolant at the pressure value obtained by the pressure sensor 46. Since this system has a feature that combines the cooling device of the internal combustion engine 10 with a steam generator for driving the expander, the feeding of the excess coolant might bring the coolant passage 12 into an overcooling state, which might reduce the generating-steam ability. Thus, achievement of the cooling ability and the generating-steam ability needs fine adjustment of the feeding amount of the coolant. For this reason, it is preferable to always refer to the pressure sensor 46 and the temperature sensor 44.

The control of the control valve 40 by the ECU 48 has been described in the first embodiment as an example case in which the liquid-phase coolant does not flow into the gas-liquid separator 14 from the condenser 24 through the second passage 30 when the first separation temperature is greater than the second separation temperature, but may be another case.

As illustrated in FIG. 1, in order to promote cooling the coolant passage 12 by the coolant, it is preferable that the pressure relief valve 22 for reducing the pressure within the gas-liquid separator 14 is connected to the gas-liquid separator 14. In this case, the opening of the pressure relief valve 22 drastically reduces the pressure within the gas-liquid separator 14, which tends to boil the coolant vigorously within the coolant passage 12. Thus, the ECU 48 preferably controls the control valve 40 based on the pressure value obtained by the pressure sensor 46 and the temperature value obtained by the temperature sensor 44 after opening the pressure relief valve 22.

Second Embodiment

Figure 11:
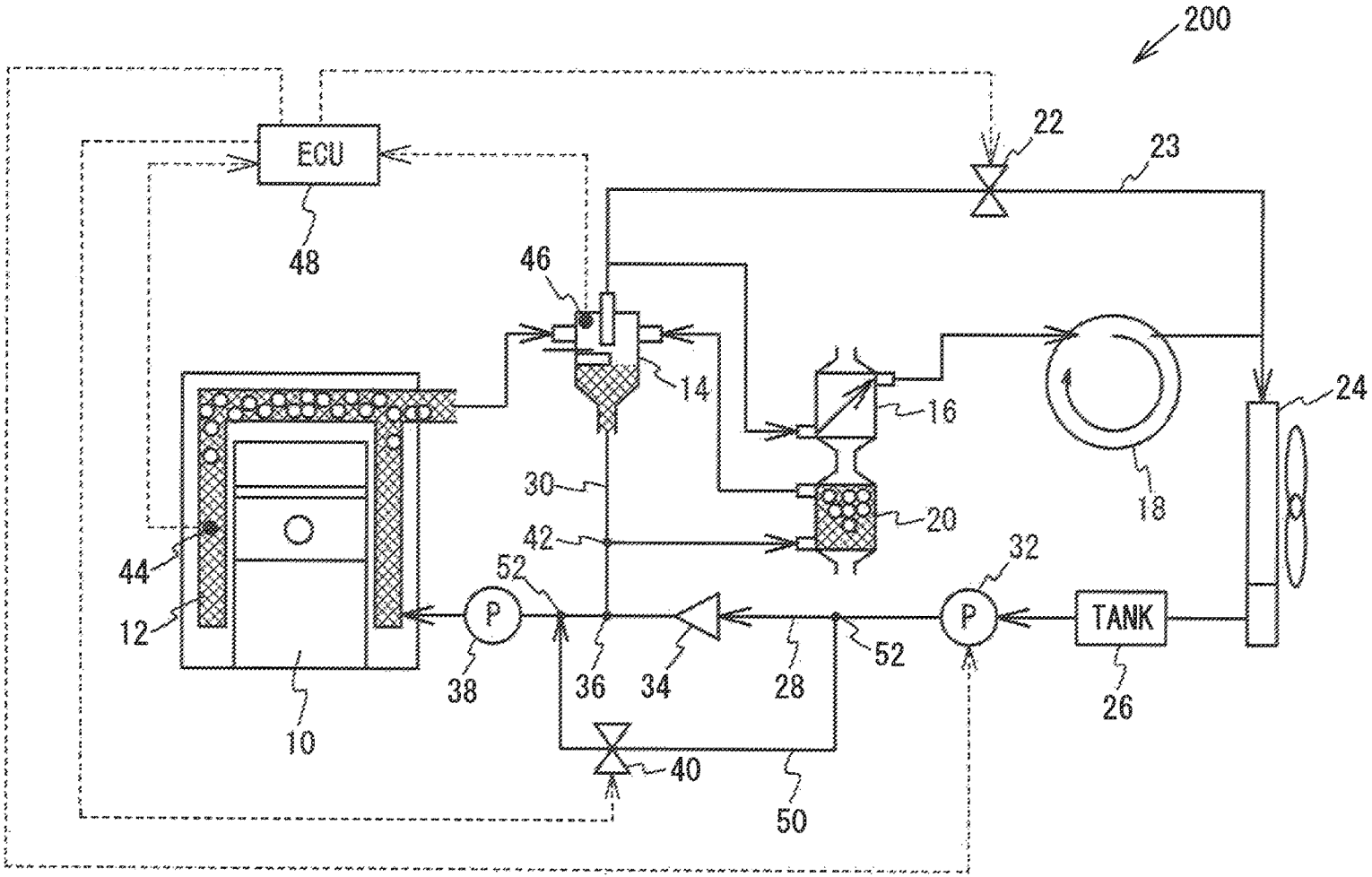
FIG. 11 is a schematic view illustrating the configuration of an ebullient cooling device according to the second embodiment.

The second embodiment is an example of the control valve 40 provided on a bypass passage bypassing the branch portion 36 between the first passage 28 and the second passage 30. FIG. 11 is a schematic view illustrating the configuration of an ebullient cooling device 200 according to the second embodiment. As illustrated in FIG. 11, the ebullient cooling device 200 according to the second embodiment is provided with a bypass passage 50 that is connected in parallel to the first passage 28 and bypasses the branch portion 36 between the first passage 28 and the second passage 30. The bypass passage 50 is connected to the first passage 28 through two connecting portions 52. The check valve 34 is provided on the first passage 28 between the upstream-side one of the two connecting portions 52 and the branch portion 36 between the first passage 28 and the second passage 30. The control valve 40 is provided on the bypass passage 50. The description of the other components is omitted because they are the same as the first embodiment illustrated in FIG. 1.

Figure 12:
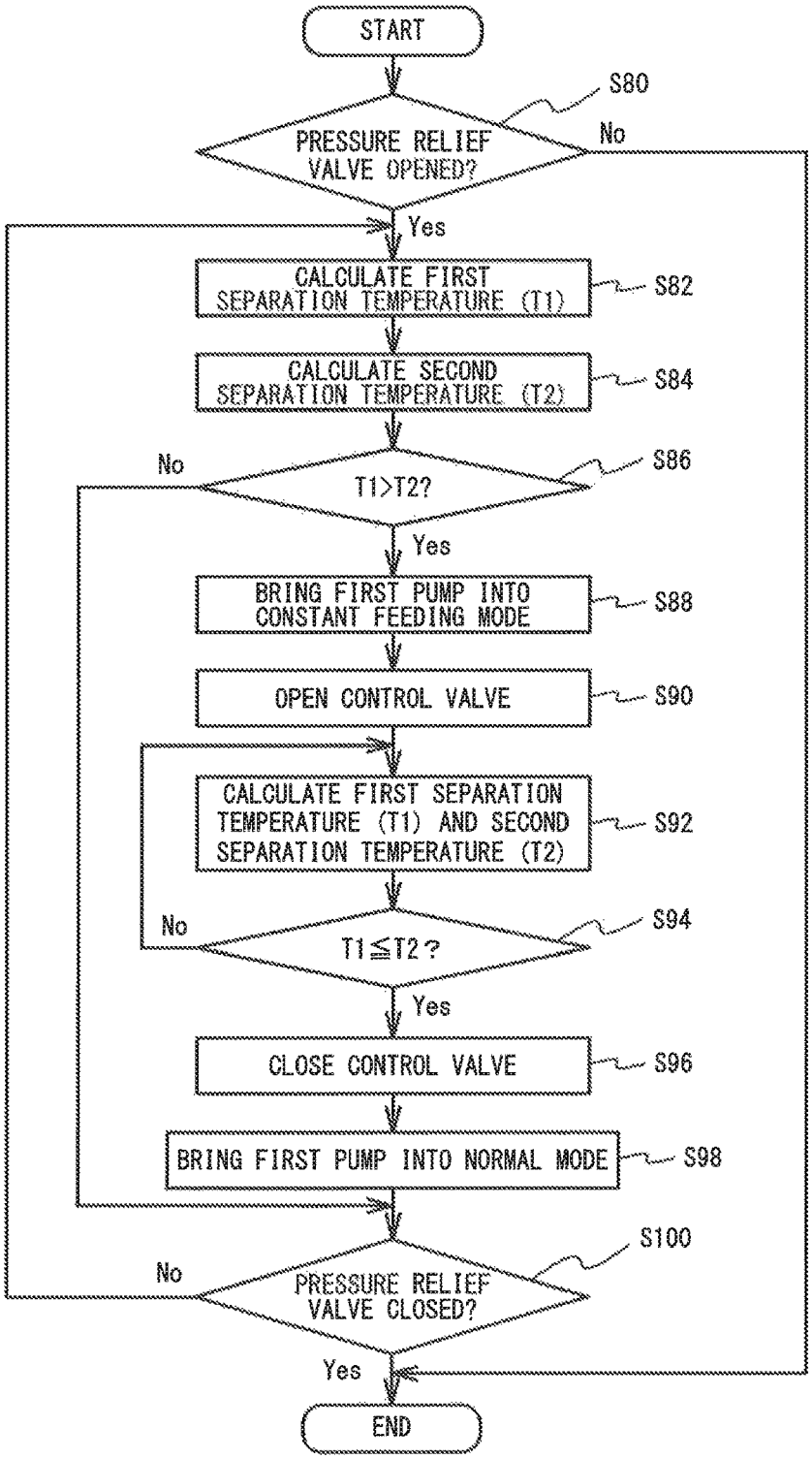
FIG. 12 is a flowchart illustrating an example of control of the ebullient cooling device according to the second embodiment.

FIG. 12 is a flowchart illustrating an example of the control of the ebullient cooling device 200 according to the second embodiment. As illustrated in FIG. 12, the ECU 48 determines whether or not the pressure relief valve 22 is opened (step S80). When the pressure relief valve 22 is opened (Yes), the ECU 48 calculates the first separation temperature (T1) and the second separation temperature (T2) (step S82, 84). The first separation temperature and the second separation temperature can be calculated in the same manner as step S12, 14 in FIG. 2 of the first embodiment.

The ECU 48 determines whether or not the first separation temperature (T1) is greater than the second separation temperature (T2) (step S86). When the first separation temperature is greater than the second separation temperature (Yes), the ECU 48 changes a mode into the mode to continue feeding the liquid-phase coolant by always driving the first pump 32 (constant feeding mode) (step S88). The ECU 48 opens the control valve 40 after changing the control of the first pump 32 in the constant feeding mode (step S90). In addition, the order of step S88 and step S90 may be changed, and step S88 and step S90 may be performed simultaneously.

The opening of the control valve 40 enables the liquid-phase coolant to flow from the condenser 24 through the bypass passage 50 side to the coolant passage 12. This is because the pressure loss in the first passage 28 is greater than that in the bypass passage 50 due to the check valve 34 provided on the first passage 28. This preferentially supplies the liquid-phase coolant to the coolant passage 12 from the condenser 24. It is thus possible to supply the sufficiently cold coolant to the coolant passage 12.

In step S86, when the first separation temperature is equal to or lower than the second separation temperature (No), the process goes to step S100 described later.

The ECU 48 calculates the first separation temperature and the second separation temperature after opening the control valve 40 (step S92), and determines whether or not the first separation temperature equal to or less than the second separation temperature due to the sufficiently cold coolant supplied to the coolant passage 12 (step S94). When the first separation temperature is still. greater than the second separation temperature (No), the process returns to the step S92. When the first separation temperature is equal to or lower than the second separation temperature (Yes), the ECU 48 closes the control valve 40 (step S96). After that, the ECU 48 returns the control of the first pump 32 to the normal mode (step S98). Additionally, the order of step S96 and step S98 may be changed, and step S96 and step S98 may be performed simultaneously.

Subsequently, the ECU 48 determines whether or not the pressure relief valve 22 is closed (step S100). When the pressure relief valve 22 is closed (Yes), the process is finished. When the pressure relief valve 22 is still open (No), the process returns to the step S82.

The first embodiment has been described as an example in which the control valve 40 provided on the second passage 30. However, like the second embodiment, the control valve 40 may be provided on the bypass passage 50 that bypasses the branch portion 36 between the first passage 28 and the second passage 30. Even in this case, the liquid-phase coolant can be preferentially supplied to the coolant passage 12 from the condenser 24 by providing the check valve 34 between the branch portion 36 and the upstream-side one of the two connecting portions 52 at which the bypass passage 50 is connected to the first passage 28. It is thus possible to suppress the coolant from boiling vigorously within the coolant passage 12.

While the exemplary embodiments of the present invention have been illustrated in detail, the present invention is not limited to the above-mentioned embodiments, and other embodiments, variations and variations may be made without departing from the scope of the present invention.

DESCRIPTION OF LETTERS OR NUMERALS

10 internal combustion engine
12 coolant passage
14 gas-liquid separator
16 superheater
18 expander
20 exhaust heat steam generator
22 pressure relief valve
23 bypass passage
24 condenser
28 first passage
30 second passage
32 first pump
34 check valve
36 branch portion
38 second pump
40 control valve
44 temperature sensor
46 pressure sensor
48 ECU
50 bypass passage
52 connecting portion
100, 200 ebullient cooling device

The invention claimed is:

1. An ebullient cooling device comprising: an internal combustion engine cooled by boiling a coolant flowing through a coolant passage formed within the internal combustion engine;

a gas-liquid separator that is disposed between the internal combustion engine and an expander, and separates a coolant discharged from the internal combustion engine into a liquid-phase coolant and a gas-phase coolant;

a condenser that is disposed on a downstream side of the expander, and cools the gas-phase coolant having passed through the expander so as to be changed into a liquid-phase coolant;

a first passage that supplies the liquid-phase coolant from the condenser to the coolant passage formed within the internal combustion engine;

a second passage that is branched from the first passage, and is connected to the gas-liquid separator;

a control valve that controls a supply state of a liquid-phase coolant supplied to the gas-liquid separator from the condenser through the second passage;

a temperature sensor that obtains a temperature value of the coolant flowing through the coolant passage;

a pressure sensor that obtains a pressure value within the gas-liquid separator; and a controller that controls the control valve based on a temperature value obtained by the temperature sensor and on a pressure value obtained by the pressure sensor.

2. The ebullient cooling device of claim 1, wherein the controller controls the control valve such that a liquid-phase coolant does not flow into the gas-liquid separator from the condenser through the second passage, when a temperature value obtained by the temperature sensor is greater than a threshold temperature predetermined at a pressure value obtained by the pressure sensor.

3. The ebullient cooling device of claim 1, wherein the controller controls the control valve such that a liquid-phase coolant does not flow into the gas-liquid separator from the condenser through the second passage, when a difference between a temperature value obtained by the temperature sensor and a boiling temperature of the coolant at a pressure value obtained by the pressure sensor is greater than a difference between a threshold temperature predetermined at a pressure value obtained by the pressure sensor and a boiling temperature of the coolant at a pressure value obtained by the pressure sensor.

4. The ebullient cooling device of claim 1, comprising a pressure relief valve that reduces the pressure within the gas-liquid separator, wherein the controller controls the control valve, on a basis of a temperature value obtained by the temperature sensor and a pressure value obtained by the pressure sensor after the pressure relief valve is opened.

* * * * *